United States Patent [19]

Best

[11] 3,996,774

[45] Dec. 14, 1976

[54] HIGH SECURITY LOCKING MECHANISM

[76] Inventor: Walter E. Best, c/o Best Lock Corporation, P.O. Box 103, Indianapolis, Ind. 46206

[22] Filed: Feb. 24, 1975

[21] Appl. No.: 552,639

Related U.S. Application Data

[62] Division of Ser. No. 456,557, April 1, 1974, Pat. No. 3,901,058, which is a division of Ser. No. 309,761, Nov. 27, 1972, Pat. No. 3,820,360.

[52] U.S. Cl. ..... 70/32; 70/34; 70/54; 70/416; 70/417; 70/DIG. 57

[51] Int. Cl.[2] ..... E05B 65/48; E05B 67/36; E05B 67/38

[58] Field of Search ..... 70/2–13, 70/23, 31–34, 54, 416, 417, 452, DIG. 43, DIG. 57, 52, 51; 292/281

[56] References Cited

UNITED STATES PATENTS

| | | | |
|---|---|---|---|
| 834,591 | 10/1906 | Streams | 70/32 X |
| 911,192 | 2/1909 | Zielenski | 70/32 X |
| 2,660,872 | 12/1953 | Beach | 70/32 |
| 3,460,861 | 8/1969 | Niilola | 292/281 |
| 3,652,114 | 3/1972 | Cady et al. | 70/56 X |
| 3,817,062 | 6/1974 | Randel | 70/32 X |
| 3,820,360 | 6/1974 | Best | 70/6 |
| 3,858,923 | 1/1975 | Bunn | 292/281 |
| 3,884,057 | 5/1975 | Maurer | 70/54 X |
| 3,901,058 | 8/1975 | Best | 70/32 |

FOREIGN PATENTS OR APPLICATIONS

| | | | |
|---|---|---|---|
| 474,653 | 8/1969 | Switzerland | 70/34 |

*Primary Examiner*—Paul R. Gilliam
*Assistant Examiner*—Carl F. Pietruszka
*Attorney, Agent, or Firm*—Jenkins, Hanley & Coffey

[57] ABSTRACT

A high security lock to secure the eyes of a hasp and keeper. The lock is of a short cylindrical shape with a rear cavity to receive and enclose the hasp and keeper eyes, and contains a locking bolt to engage such eyes.

The lock and the hasp and keeper assembly interact to give high security. The lock encloses and closely embraces the eyes of the hasp and keeper and lies close against the pads of the hasp and keeper. Shroud plates overlying the pads closely surround the rear edge of the lock. The shrouds and plates of the hasp meet those of the keeper at a separation plane offset from that of the eyes and of the door and its jamb.

2 Claims, 9 Drawing Figures

HIGH SECURITY LOCKING MECHANISM

This invention is a division of my application, Ser. No. 456,557, filed Apr. 1, 1974, now U.S. Pat. No. 3,901,058 which was a division of my prior application, Ser. No. 309,761, filed Nov. 27, 1972, now U.S. Pat. No. 3,820,360, granted June 28, 1974, and relates to an improved hasp and keeper having overlying shroud plates arranged to protect a round lock combined therewith.

BACKGROUND OF THE INVENTION

In this specification, the terms "hasp" and "keeper" are used to designate two members or bars used to lock doors and the like, which have forward-projecting, apertured eyes adapted to be locked together, as by a padlock. The hasp and keeper shown are fastened to the door structure by plates or pads, but other forms may be used. For convenience, the hasp is considered to be the door-mounted or movable plate while the keeper is considered to be the frame-mounted or fixed plate, but such plates may be reversed and may be used not only on swinging and sliding single doors, but also on double doors, and these terms are for convenience only and are not to be construed as limiting.

In door-closed relationship, the eyes of the hasp and keeper project from the face of the door structure in face-to-face parallel relation. It is common practice to lock such eyes with heavy padlocks, but these have not been wholly satisfactory. It has also been proposed, as in my prior applications, to lock the eyes together with a round lock which encloses the projecting eyes.

It is the purpose of the present invention to combine a round lock such as shown in my prior applications with a specially-formed hasp and keeper having overlying shroud plates which protect the lock from forced-entry attack and enhance the security provided.

SUMMARY OF THE INVENTION

In accordance with the present invention, the lock body may be as shown in my U.S. Pat. No. 3,820,360. As here shown, it is formed of a one-piece main housing and a rear closure plate, held together by a rotatably-engaged retaining means, such as a breech lock, and held against release by a key-removable lock-core so as to secure them against disassembly even when removed from the hasp and keeper. The main housing is preferably formed as a rounded body with generally cylindrical side surfaces and a rounded front. The housing and closure together define a rearward-open cavity offset from the center of the lock to receive and enclose the eyes of the hasp and keeper. The lock contains a slidable lock bolt to lock the two eyes together. The housing also contains two chambers which receive key-operated lock cores. One core is a lock-operating core having a key plug connected to operate the bolt, and operated by a key inserted through a front opening in the housing. The other core extends into the housing from the rear through a registering opening in the closure so as to block the closure plate against rotation to release it from the housing.

The hasp and keeper provided in accordance with the present invention comprise pads to be secured to the door and the door frame, having forward-projecting apertured eyes which in locking position lie in face-to-face parallel relation for reception into the formed cavity in the lock. Desirably, shroud plates overlie the pads of the hasp and keeper and closely surround the rear edge of the lock to prevent insertion of a prying bar or the like behind the lock.

Desirably, the eyes are positioned at the meeting edges of the door and door jamb so as to have a common separation plane therewith, and the separation plane between the meeting edges of the hasp and keeper pads is offset therefrom in the direction toward the door jamb, so that the hasp pad and shroud plate overlap the jamb. This allows the shroud plates to be symmetrical and places the eyes in an offset position in the recess defined by the shroud plates to match the offset position of the eye-receiving cavity in the lock. The offset separation planes enhance security against cutting.

BRIEF DESCRIPTION OF THE DRAWINGS

The accompanying drawings illustrate the invention and show an exemplifying embodiment. In such drawings.

DETAILED DESCRIPTION OF THE PREFERRED EMBODIMENT

Figure 1:
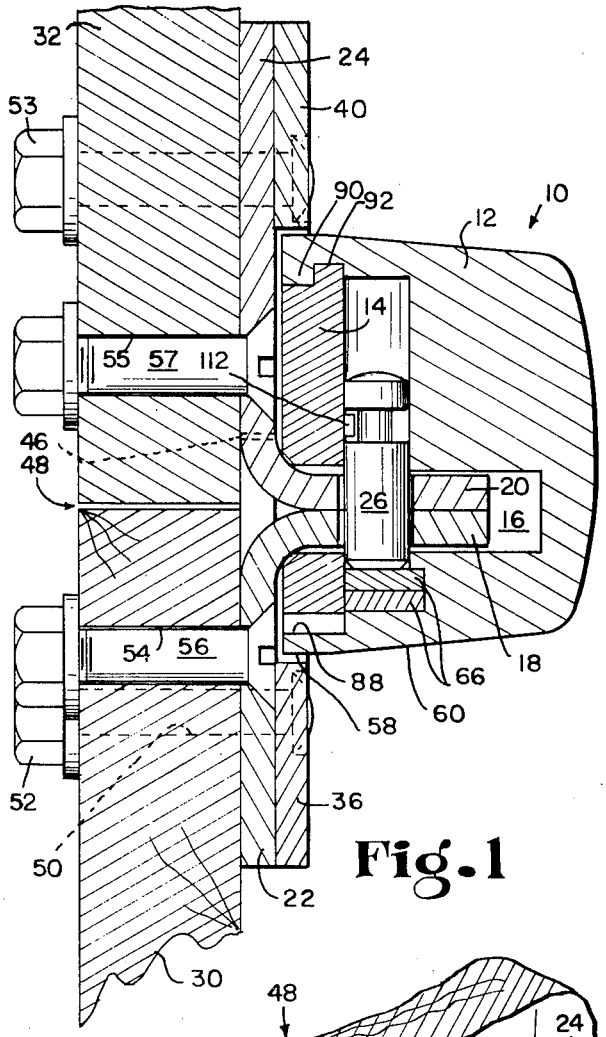
FIG. 1 is a horizontal section taken on the line 1—1 of FIG. 4, showing a lock in locked relation with a hasp and keeper, in accordance with the invention.

The lock 10 shown in the drawings comprises a housing 12 of generally circular cross-section with a rounded front portion, closed at the rear by a closure 14 seated in a recess in the housing. The lock defines a rearwardly open chamber 16 to receive the forward projecting eyes 18 and 20 of a hasp 22 and keeper 24, and contains a slidable bolt 26 which is shown in FIG. 1 in locked position engaged in the apertures of the eyes 18 and 20.

Figure 2:
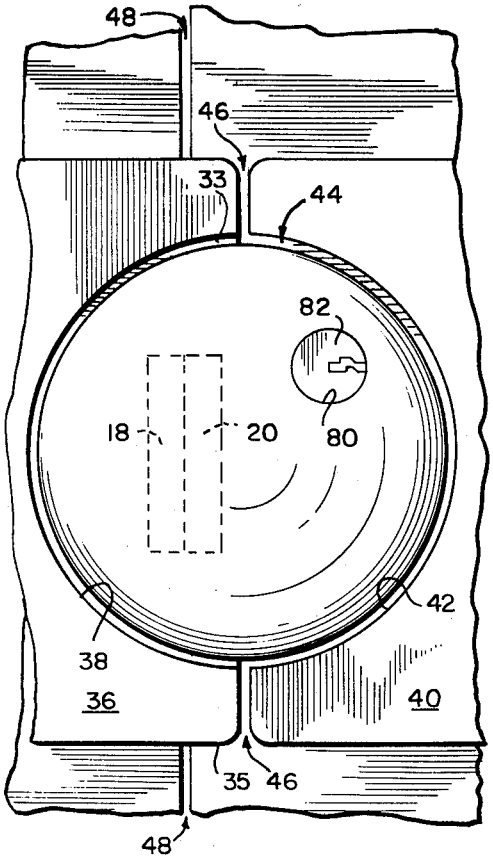
FIG. 2 is a fragmental front elevation of the assembly shown in FIG. 1.
Figure 3:
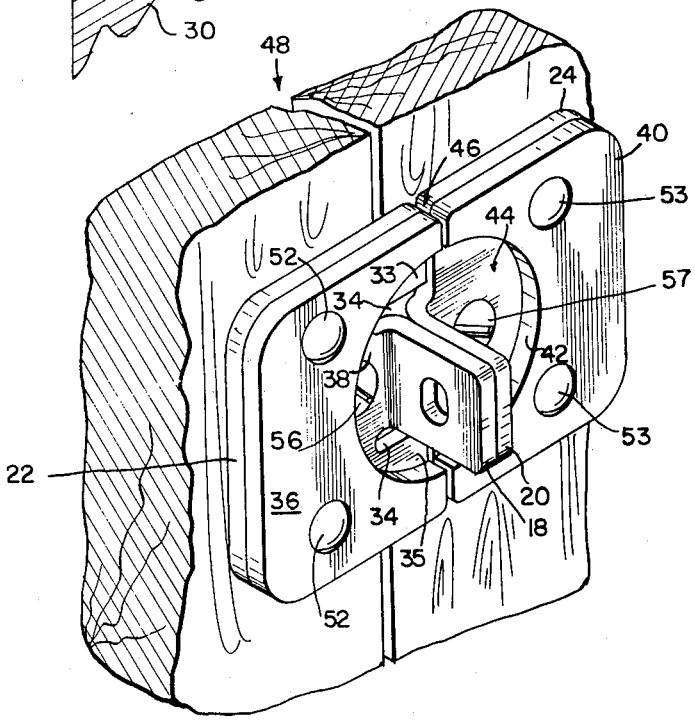
FIG. 3 is an isometric view of the hasp and keeper assembly, shown in relation to a door and a jamb.

The hasp and keeper are preferably as shown in FIGS. 1–3. The hasp 22 has a rear pad fastened to a door 30, and the keeper 24 has a rear pad fastened to a door jamb 32 or to a companion door. As shown in FIG. 3, the hasp 22 is formed of heavy metal plate of generally rectangular configuration, with a pair of slots 34 formed in its right edge to define between them a tab which is apertured and bent forward to form the eye 18 offset inward from the right edge of the hasp. The keeper 24 is of similar metal plate, of generally rectangular configuration, but does not have notches 34 at its edge and instead is formed with a projecting tab which is apertured and bent forward to form the eye 20 offset outward from the left edge of the keeper.

A shroud plate 36 overlies and the pad of the hasp 22, and is formed of similar steel plate and rectangular configuration, but has a semicircular cut-out 38 at its right edge. A similar shroud plate 40 overlies the keeper pad 24, and this likewise has a semicircular cut-out 42. The two cut-outs are complementary so that the two shroud plates define a circular recess 44 which contains the rear end of the lock 10 when such lock is in locked position as shown in FIG. 1.

As seen in FIGS. 2 and 3, the adjacent edges of the hasp assembly and keeper assembly lie in closely spaced relation and define a separation slot 46 which is offset from the eyes 18 and 20. Preferably, the meeting faces of the eyes 18 and 20 lie coplanar with the separation slot 48 between the door 30 and the jamb 32, while the separation slot 46 is offset therefrom toward the keeper. This causes the upper and lower portions 33 and 35 of the hasp pad to project across the separation slot 48 between the door and jamb, and overlap the edge of the jamb 32. The separation slots 46 and 48 are thus out of alignment so as to hinder insertion of a saw to saw the lock.

The hasp and keeper assemblies may be secured to the door and jamb by bolts. As shown, the hasp pad 22 and its overlying shroud plate 36 are provided with registering bolt holes 50, and the holes in the plate 36 are recessed and shaped to receive the heads and squared shanks of carriage bolts 52. The squared shank portions of such bolts fit in complementary squared portions of the holes 50 to prevent the bolts from being turned from the outside. In addition to two bolt holes 50, the hasp pad has a bolt hole 54 close to the base of the eye 18. This is provided with a tapered seat to receive the flat head of a bolt 56, and such head lies at or below the face of the hasp pad 22 and partially underlies the overlying shroud plate 36. The keeper assembly is similarly mounted. It has two shaped and recessed bolt holes to receive carriage bolts 53, and has a bolt hole 55 close to the base of the eye 20 to receive the flathead bolt 57. The bolts 56 and 57 may be slotted as usual with flathead bolts, or may be break-away bolts which originally have gripping projections which are broken off after the bolts have been set.

When a lock 10 is locked on the hasp and keeper, its cavity 16 totally encloses and surrounds the eyes 18 and 20, and its bolt 26 is deadlocked through the apertures of those eyes. The rear edge of the housing 12 lies within the recess 44 defined by the shroud plates 36 and 40, and such shroud plates closely surround the rear edge of the lock to prevent insertion of a pry bar or other tool between the lock an the hasp or keeper.

The hasp and keeper assembly here shown may be made in a size and proportions for use with a lock as shown in my U.S. Pat. No. 3,820,360, but as here shown is preferably used with a lock 10 of the construction shown in FIGS. 4–8.

The lock shown in FIGS. 4–8 comprises the housing 12 and a closure member 14, both of which are adapted to be made as precision castings and to require a minimum of machining. The housing 12 is a solid body of circular cross-sections with a rounded front end. At the rear, it has a short section 58 of truly cylindrical shape, and a longer forward portion 60 of generally frusto conical configuration. The housing 12 is shaped to form a rearward-open rectangular eye-receiving cavity 16, and a transverse trough 62 forming a slideway for the bolt 26. At the forward end of such trough 62, it connects with a wider and deeper slot 64 having a round bottom, which receives a pair of hardened steel plates 66 lying across the end of the bolt 26 to prevent drilling the bolt.

Figure 7:
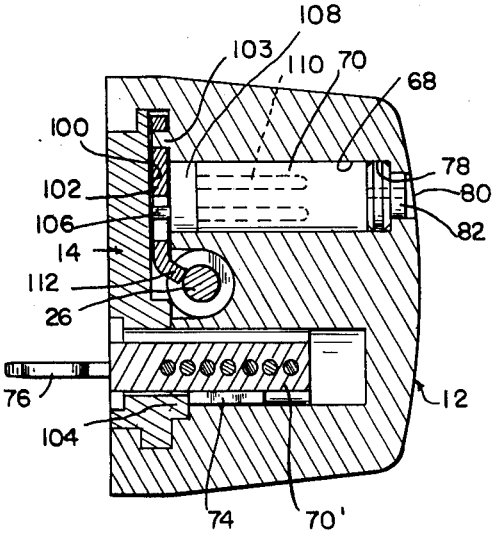
FIG. 7 is a section taken on the line 7—7 of FIG. 6, showing a section of an assembled lock.

The housing 12 also has a rearward-open chamber 68 to contain an operating lock core 70. Such lock is preferably of the type shown in FIG. 8. This comprises a lock body of figure-eight shape having a lower lobe containing a key plug 72, and an upper lobe which contains pin tumblers. The core includes a retaining lug 74 shown in projecting position in FIG. 8, which is adapted to be retracted into the body of the core by operation of a special control key 76. The cavity 68 is of corresponding figure-eight cross-section, and has clearance at the side for the lug 74. As shown in FIG. 7, the lobe of the cavity 68 which contains the key plug 72 extends forward from the main cavity 68 to provide a circular recess 78, and extends therebeyond on a smaller diameter to provide a key access opening 80 through the front face of the housing 12. A hardened steel disc 82 is mounted in the recess 78 and the key access opening 80 and is slotted to admit a key to the key plug 72.

The body of the housing 12 is also formed with a blind second cavity 84 of figure-eight cross-section, to receive a second lock core 70' to retain the closure 14 in place, as described below.

Figure 5:
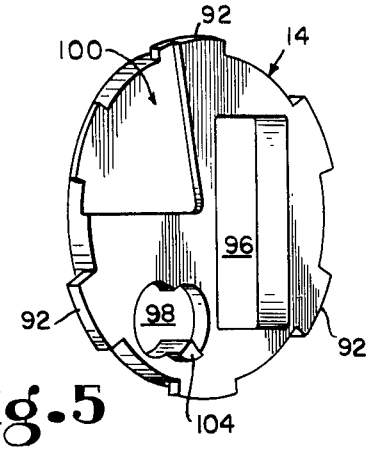
FIG. 5 is a perspective view of the lock closure plate.
Figure 4:
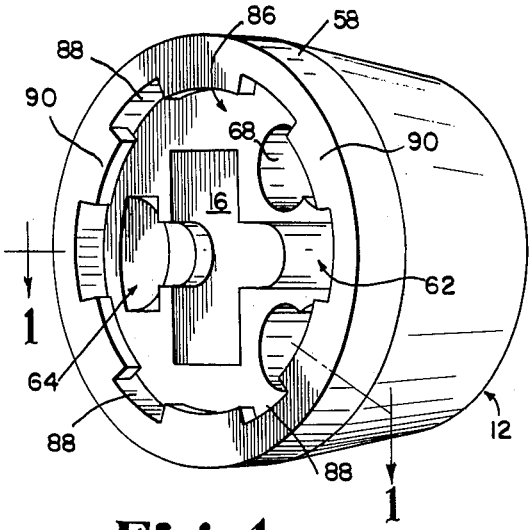
FIG. 4 is a perspective view of the lock housing.

The rear of the housing 12 is formed with a generally circular recess 86 to receive the closure plate 14. Such recess has a series of circumferentially-spaced rectangular notches 88 about its periphery. The thick wall about the recess 86 and containing the notches 88 is machined to undercut the material between the notches 88, so as to leave inwardly projecting lugs 90 for breech lock engagement with the closure plate 14 which is seated in the recess 86. As shown in FIG. 5, the closure plate 14 is a generally circular disc having projecting lugs 92 spaced about its periphery and arranged to register with the notches 88 of the housing 12. The closure plate 14 contains an opening 96 which registers with the cavity 16 in the housing 12 to admit the hasp and keeper eyes 18 and 20 thereto. The closure also has an opening 98 of figure-eight shape positioned to register with the cavity 84 of the housing 12 when the closure plate is in locked position in the housing 12. The inner face of the closure 14 is formed with a shallow sector-shaped recess 100 to provide clearance space for a throw lever 102 for actuating the bolt 26.

For assemblying the closure plate 14 to the housing 12, the closure is inserted in the recess 86 at the rear of the housing 12, with the lugs 92 of the closure entering the notches 88 of the housing, and the closure is then rotated 30° clockwise to carry the lugs 92 of the closure plate beneath the lugs 90 of the housing. Such rotation carries the opening 96 of the closure plate into registry with the eye-receiving housing cavity 16, and carries the figure-eight opening 98 of the closure plate into registry with the figure-eight cavity 84. A core 70' is then inserted in the aligned opening 98 and cavity 84 and is secured in place to prevent rotation of the closure from locked to unlocked position.

For purposes of locking the core 70' in the aligned opening and cavity, the closure 14 is provided with a rearward projecting lug 104 at one edge of the opening 98, at the intersection of the two lobes of the figure-eight opening. Such lug 104 is of sufficient length so that when the core 70' is inserted, the retaining lug 74 may be moved behind the end of the lug 104 to lock the core 70' in place in the opening and cavity. The lug 104 is shown in section in FIG. 6, at the lower side of cavity 84 and at the intersection of the two lobes of that figure-eight cavity. Since such lug 104 is on the closure which must rotate through 30° as it is assembled to the housing, it is necessary to provide a clearance path for movement for such lug 104 through 30°. For this purpose, a rounded notch 106 is formed at the end of the figure-eight cross-section of the cavity 84 to provide for that 30° range of movement of the lug 104. The notch 106 needs to be only deep enough to clear the end of the lug 104.

The mechanism of the lock includes the housing 12 and the closure 14, shaped as described above, and provided with rotatably engageable retaining means such as the breech lock lugs 90 and 92 described. It also includes other mechanism, as follows: The bolt 26 is slidably mounted in the trough 62 for movement between a locked position shown in full lines and a retracted position shown in dotted lines in FIG. 6. It is moved between these two positions by the throw lever 102, which is pivoted on a pin 103 formed or inserted in the housing 12, and actuated by a crank 106 received in a slot 107 in the lever. The crank is carried by a throw member 108 positioned behind and driven by the key plug 72 of the locking core 70 mounted in the cavity 68 of the housing 12. The rear end of the key plug 72 is provided with two deep holes, which receive legs 110 on the throw member 108. The throw lever 102 lies in the shallow recess 100 and is held in place by the closure 14. The lever has a bent-over end 112 engaged in a circular notch 114 in the bolt 26. With this arrangement, operation of the key plug 72 with an operating key inserted through the slotted disc 82 will rotate the throw member 108 to carry its crank 106 from its full line position to its dotted line position in FIG. 6, and this will retract the bolt 26 from locked position to retracted position.

Assembly of the lock is as follows: A protective disc 82 is inserted in the recess 78 at the bottom of the cavity 68. An operating core 70 is then inserted with the key opening toward the disc 82. A throw member 108 is then inserted in the rear of the key plug 72 of the operating core 70. A bolt 26 is laid in the trough 62, and a throw lever 102 is engaged over the pivot 103 with its bent-over end 112 engaged in the notch of the bolt 26. Protective plates 66 are then inserted in the cavity 64 at the end of the bolt trough 62.

Figure 8:
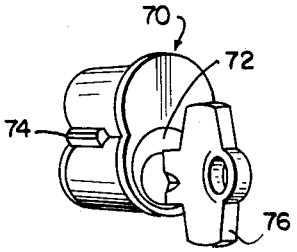
FIG. 8 is an isometric view of a key-removable core used in accordance with the invention.
Figure 6:
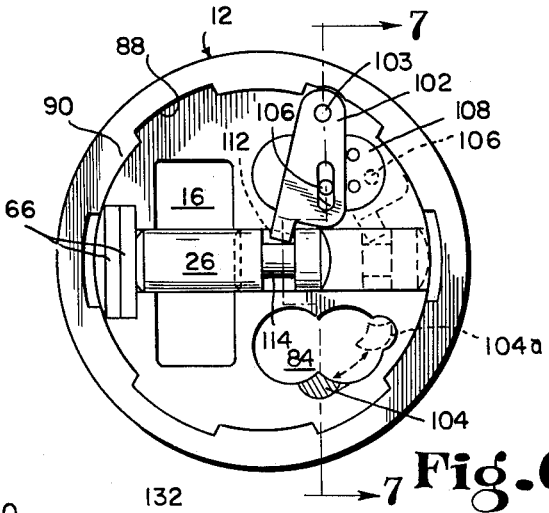
FIG. 6 is a rear elevation of the lock housing with parts assembled therein ready for application of the closure plate.

With these parts in place, the closure plate 14 is then inserted in the recess 86, with its breech-lock legs 92 in the notches 88 of the housing 12 and with its core-retaining lug 104 in the dotted line position 104*a* shown in FIG. 6. The closure plate is then rotated clockwise to carry the lug 104 to its position shown in section in FIG. 6. Such rotation carries the breech-lock lugs 90 and 92 into locking engagement and carries the closure openings 96 and 98 into registry with the housing cavities 16 and 84. A retaining core 70′ is then inserted in the registering opening 98 and and cavity 84. For this purpose, a control key 76 is inserted in the key plug 72 and rotated clockwise 15° to retract the retaining lug 74 from its projected position as shown in FIG. 8. The core is then inserted to carry the lug 74 behind the rear end of the lug 104 on the closure 14, and the control key is then turned in reverse rotation to project the retaining lug 74 behind the lug 104, and this locks the core 70′ in place. The control key 76 is then withdrawn.

The lock can be disassembled only by using a control key 76 to retract the retaining lug 74 and remove the retaining core 70° from the opening 98 and cavity 84. Until this is done, the retaining core 70′ prevents rotation of the closure 14 to an unlocked position.

Use of the lock to lock a hasp and keeper as shown in FIG. 1 is as follows: With an operating key inserted through the guard disc 82, the key plug 72 is rotated to retract the bolt 26 from its locked position as shown in FIGS. 1 and 6. The lock 10 can then be installed or removed from the eyes 18 and 20 of the hasp and keeper. When the lock has been installed to the position shown in FIG. 1, the operating key is rotated to advance the bolt 26 to its locking position, and the key is then removed. The lock housing then lies close against the face of the pad portion of the hasp 22 and keeper 24, with its rear end positioned in the recess formed by the shroud plates 36 and 40. Such plates closely surround the lock to protect it from prying. The center of the lock is in the plane of the separation slot 46 between the hasp and keeper and such slot is offset from the door separation slot 48 so that the end portions 33 and 35 of the hasp overlap the door part which carries the keeper. The combination provides a high degree of security.

Figure 9:
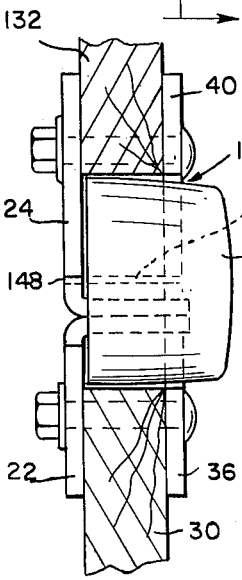
FIG. 9 is a horizontal section, like FIG. 1, showing a modified assembly arrangement, in which the pad plates of the hasp and keeper are mounted against the rear face of the door structure and the shroud plates are mounted against the front face of the door structure.

The modified assembly shown in FIG. 9 is similar. In such modification, the hasp 22 is mounted with its pad against the inner face of the door 130, and the keeper 24 is mounted against the inner face of the companion door 132. The shroud plates 36 and 40, instead of being mounted against the faces of the hasp and keeper pads, are mounted against the front faces of the doors. In this case, the separation slot 148 between the doors is coplanar with the slot 146 between the meeting edges of the hasp and keeper and their shroud plates. The edges of the doors are cut away, as with part-cylindrical notches, so that together they form a deep cylindrical recess 120 aligned with the cylindrical recess defined by the shroud plates 36 and 40. This admits the lock 10 to be inserted through the shroud plates 36 and 40 into engagement with the eyes 18 and 20, and to be locked in place thereon as before. The lock is then largely contained within the deep recess 120 and thereby further protected from forced-entry attack.

I claim:

1. A locking mechanism comprising a hasp including a flat pad adapted to be secured to the face of a door at the edge of the door, said hasp having upper and lower arms extending beyond the edge of the door so as to overlap the edge of an adjacent jamb or companion door, a central tab between said upper and lower arms projecting forward from said pad to form a hasp eye spaced inward from the ends of the arms so as to stand with its outer face in substantial alignment with the edge of the door, a keeper including a flat pad adapted to be secured to the face of the jamb or companion door to lie substantially coplanar with the hasp pad when the hasp is in door-closed position, said keeper having upper and lower portions of its front edge positioned to lie in opposed clearance relation with the ends of said arms, a central tab connected to the edge of said keeper pad between said upper and lower portions and projecting forward from said pad in outward offset relation with said edge to form a keeper eye spaced outward from said edge so as to stand with its outer face in substantial alignment with the edge of said jamb or companion door and in parallel face-to-face relation with the hasp eye, said hasp and keeper having aligned apertures for the reception of the shackle or bolt of a lock to secure the same together and thereby lock the door to said jamb or companion door, a hasp shroud plate fitting against the face of said hasp pad and having a cut-out in its outer edge, a keeper shroud plate fitting against the face of said keeper pad and having an edge cut-out to clear said keeper eye, the cut-outs of said two shroud plates together defining a recess about the base of said forward-projecting eyes, and a lock having a housing shaped to fit within said recess and enclose said eyes, and having a bolt within said housing engageable with said eyes to lock the hasp and keeper together.

2. A locking mechanism as in claim 1 in which said cut-outs are semicircular and together define a circular recess about said eyes in door-closed position, and said lock is of circular cross-section with a rear edge portion lying in said recess in close clearance relation with the edges of the shroud cut-outs so that the shrouds hinder insertion of a pry-bar or the like behind the lock.

* * * * *